United States Patent [19]

Fairbank

[11] 4,285,447

[45] Aug. 25, 1981

[54] SUSPENSION FOR BIN DISCHARGING DEVICE

[75] Inventor: Paul Fairbank, Stroud, England

[73] Assignee: Simon-Solitec Limited, Gloucester, England

[21] Appl. No.: 126,849

[22] Filed: Mar. 3, 1980

[30] Foreign Application Priority Data

Mar. 6, 1979 [GB] United Kingdom ..... 07921/79

[51] Int. Cl.[3] ..... B65G 65/44

[52] U.S. Cl. ..... 222/200; 198/533; 248/609; 403/225

[58] Field of Search ..... 248/609, 621, 638; 198/533; 406/134; 222/196, 200, 564, 547; 403/225, 226, 228

[56] References Cited

U.S. PATENT DOCUMENTS 3,173,583 3/1965 Wahl ..... 222/200 X

FOREIGN PATENT DOCUMENTS 886983 8/1953 Fed. Rep. of Germany ..... 403/225
2504832 8/1975 Fed. Rep. of Germany ..... 222/200
2443309 3/1976 Fed. Rep. of Germany ..... 222/200
2703458 8/1978 Fed. Rep. of Germany ..... 222/196
55770 1/1975 Switzerland ..... 222/196

*Primary Examiner*—David A. Scherbel
*Attorney, Agent, or Firm*—Norris & Bateman

[57] ABSTRACT

A bin-activator of the kind which is supported beneath the outlet opening of a bin or hopper and which is vibrated to facilitate discharge of material from the bin or hopper, the bin-activator being suspended by a plurality of hangers (17) each of which extends between a fixed part on the bin or hopper, and the bin-activator itself, and each hanger comprising a vertically disposed rod (19) mounted in resilient bushes (22, 23) adjacent its upper and lower ends, the bushes surrounding a portion of the length of the rod, and themselves surrounded by a pair of rigid sleeves (24, 25) and the whole assembly being held together by means of nuts (26, 27) screwed onto the ends of the rod, such that pivoting movement of the rod with respect to the bin or hopper and the bin-activator, to effect horizontal movement of the bin-activator, is restricted by the resilient bushes.

10 Claims, 3 Drawing Figures

SUSPENSION FOR BIN DISCHARGING DEVICE

This invention relates to so-called bin-activators of the kind which are supported adjacent a bin or hopper beneath the outlet opening thereof and which are vibrated to facilitate discharge of material from the bin or hopper.

A common and widely used form of bin-activator takes the form of a conical or dish-shaped material received member having a central discharge opening and rigidly secured thereto an upwardly directed conical or dish-shaped baffle which overlies the central discharge opening, the whole being arranged to be vibrated in a horizontal plane by means of a vibration motor or other vibration inducing device.

Bin-activators are normally suspended on hangers extending downwardly from a fixed frame or brackets generally secured to the bin or hopper itself, the hangers incorporating resilient mounts at their upper and lower ends, firstly to permit vibrational movement of the bin-activator and secondly to isolate the fixed frame or brackets from vibration.

It is well known that a bin-activator of the kind mentioned above operates optimally if both the frequency of vibration and the amplitude of vibration can be adjusted depending upon the kind of material which is to be discharged. Whilst it is a simple matter to adjust the frequency of vibration by adjusting the speed of the vibration inducing motors or the like, it has been relatively difficult to control the amplitude of vibration. Also with the conventional hangers problems have arisen in that the bin-activator can move away from a central position thus placing considerable strain on the hangers and parts associated therewith.

The present invention is based upon an appreciation of the possibility of providing a suspension system for bin-activators which can be readily adjusted to control the amplitude of vibration and which constrains the bin-activator to a central position.

According to the present invention, a bin-activator of the kind referred to is characterized in that it is suspended by a plurality of hangers, each of which extends between a fixed part and the bin-activator itself, each said hanger comprising an upright rod whose ability to execute pivoting movement is restricted by bushes of resilient material surrounding the upper and lower end regions of the rod respectively and which themselves are surrounded by fixed rigid sleeve members connected with the fixed part and bin-activator respectively.

The invention will be further apparent from the following description with reference to the several figures of the accompanying drawings which show, by way of example only, one form of bin-activator having suspension means embodying the invention.

Figure 1:
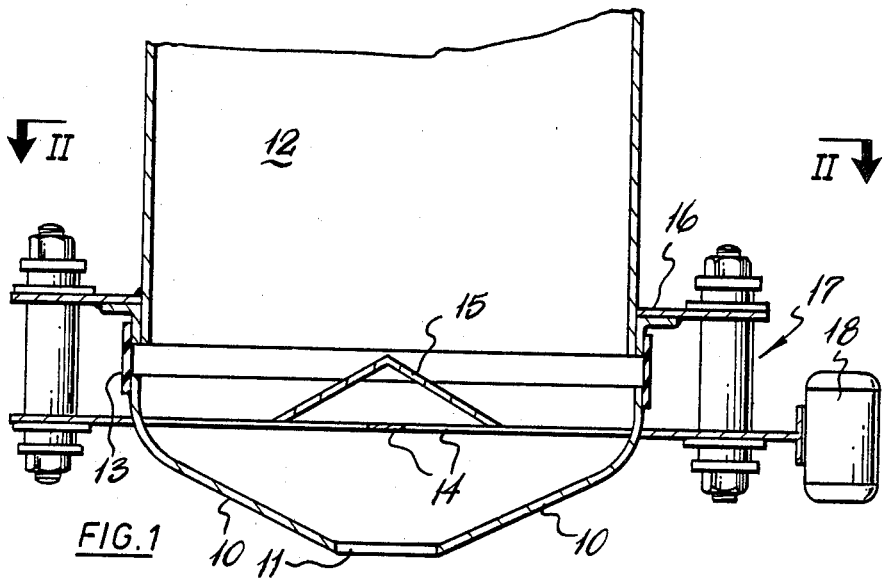
FIG. 1 shows a vertical cross-section through a bin or hopper fitted with the bin-activator at its lower end.
Figure 2:
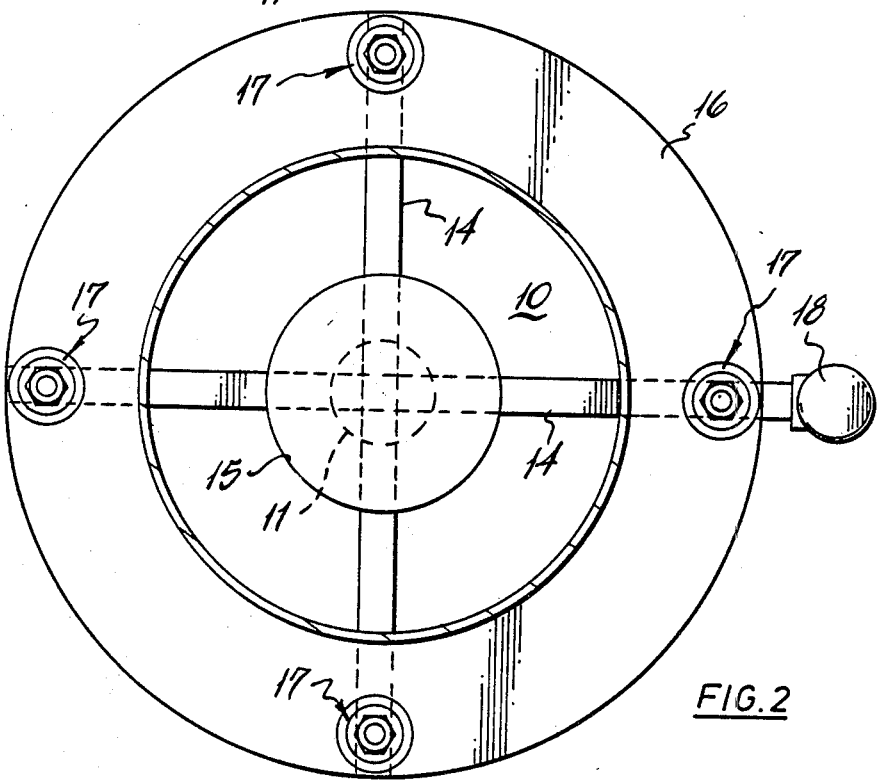
FIG. 2 shows a cross-section through the bin or hopper on the line II—II of FIG. 1.
Figure 3:
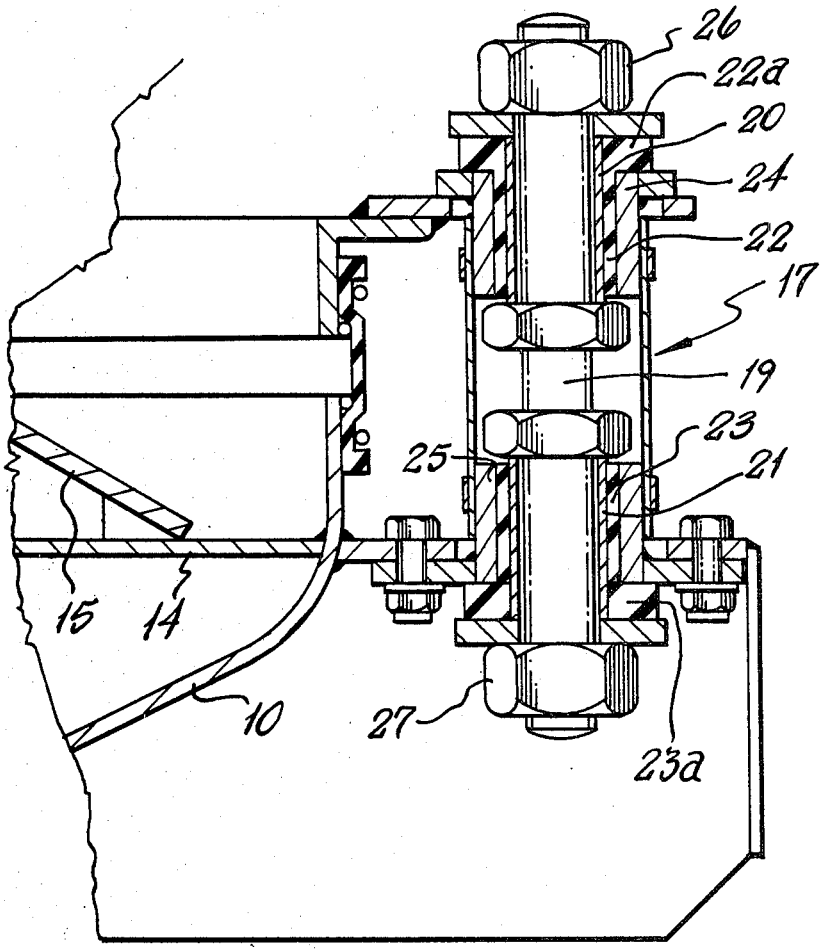

and FIG. 3 shows a cross-section through one of the suspension hangers of the bin-activator of FIGS. 1 and 2 and on an enlarged scale.

Referring now to the drawings, it will be seen that the bin-activator is essentially comprised by a dish-shaped material receiving member 10, having a central discharge opening 11, which is mounted beneath the outlet of a bin or hopper 12. A resilient sealing ring 13 is provided between the peripheral edge of the material receiving member 10 and the peripheral edge of the lower end of the bin or hopper 12.

A generally cruciform frame 14 is located within the interior of the material receiving member 10, each of the limbs thereof extending outwardly from the periphery of the member 10 for a purpose which will be apparent hereinafter. The frame 14 serves to support an upwardly directed conical baffle 15 which is located within the material receiving member and over the discharge opening 11.

Surrounding the bin or hopper 12 and fixed thereto is an annular frame member 16. Four suspension hangers generally indicated at 17 extend generally vertically between the frame member 16 and each of the four limbs of the frame 14 respectively. One of the limbs of the frame 14 extends outwardly beyond its associated hanger 17 to carry on out-of-balance vibration motor generally indicated at 18.

Referring now to FIG. 3, it will be seen that each of the suspension hangers 17 is essentially comprises by a rod whose upper and lower ends extend through apertures in the frame member 16 and associated limb of frame 14 respectively. Rigid flanged sleeves 20 and 21 surround the upper and lower end regions of the rod 19 respectively and are themselves surrounded by resilient bushes 22 and 23 of a rubber material. The bushes are integrally formed with flanges **22*a* and 23*a* which abut the flanges of the sleeves 20 and 21**.

The bushes 22 and 23 are located within further rigid flanged sleeves 24 and 25 which are fixedly secured within the apertures of the frame member 16 and limb of frame 14 respectively. The flanges of the sleeves 24 and 25 abut the faces of the flanges **22*a* and 23*a* opposite the flanges of the sleeves 20 and 21**.

The rod 19 is secured in position by means of nuts 26 and 27 which bear against the flanges of the inner sleeve 20 and 21 to compress the resilient flanges **22*a* and 23*a***.

In use, when the vibration motor 18 is operating the bin-activator and frame member 14 will be free to vibrate in a horizontal plane but only to a limited extent. After the material of the bushes 23 and 24 has been compressed by such horizontal movement of the member 14 to a certain extent it effectively prevents further vibrational movement.

Obviously the amplitude of movement of the bin-activator which is permitted is dependent upon the extent to which the rods 19 can swing angularly. This can be controlled by adjusting the length of the bushes 22 and 23. Clearly, the longer the bushes 22 and 23, the more restricted is the angle through which the rods 9 can move and the smaller the amplitude of vibration of the bin-activator.

It will be understood that when installing a bin activator having suspension hangers 17 of the kind described herein, the installing engineer can shorten the bushes 22 and 23 to a desired extent, precisely to tune the machine optimally for the kind of material which it is to handle.

A further advantage of the suspension described is that the bin activator is constrained to maintain a generally central position.

It will be appreciated that it is not intended to limit the invention to the above example only, many variations such as might readily occur to one skilled in the art, being possible without departing from the scope thereof.

What is claimed is:

1. A bin-activator supported beneath a bottom outlet opening of a bin or hopper and having means for vibrating the activator to facilitate discharge of material from the bin or hopper, characterized in that the bin-activator is suspended from the bin or hopper by a plurality of hangers, each of which extends between a fixed part of the bin or hopper and the bin-activator itself, each said hanger comprising an upright rod having pivoting movement relative to said fixed part and to said bin-activator, bushes of resilient material surrounding portions of the rod near to the ends thereof and restricting the relative movement between said fixed part and said bin-activator, said bushes themselves being surrounded by fixed rigid sleeve members connected with said fixed part and said bin-activator respectively.

2. A bin-activator according to claim 1, wherein said fixed part comprises a rigid member attached to the wall of the bin or hopper in its base region.

3. A bin-activator according to claim 1, wherein each said resilient bush has, at its outermost end, a flange disposed to abut an end face of the associated one of said rigid sleeve members.

4. A bin-activator according to claim 3, wherein each said rigid sleeve member has, at its outermost end, a flange, the flanges of the bushes abutting the flanges of the sleeve members.

5. A bin-activator according to claim 1, wherein the assembly of each rod and its associated resilient bushes and rigid sleeve members, is held together by means of nuts screwed onto the ends of said rod.

6. A bin activator according to claim 5, including a rigid member disposed between each said nut and its associated resilient bush.

7. A bin-activator according to claim 6, wherein said rigid member comprises the flange of a further flanged sleeve surrounding the rod with the sleeve located within the associated resilient bush.

8. A bin-activator according to claim 1, wherein said resilient bushes may be of different lengths so that the ability of each said rod to execute pivoting movement may be selected by changing the length of said resilient bushes.

9. A bin-activator according to claim 1, comprised by a dish-shaped material receiving member having a central discharge opening and a cruciform frame located within its interior, each limb of said frame extending radially outwardly from the periphery of the member, each said outward extension carrying one of the suspension hangers.

10. A bin-activator according to claim 9, wherein one of said limbs extends outwardly beyond its associated hanger and carries an out-of-balance vibration motor.

* * * * *